US007552797B2

(12) United States Patent
Luttig

(10) Patent No.: US 7,552,797 B2
(45) Date of Patent: Jun. 30, 2009

(54) VEHICULAR EXHAUST SYSTEM

(75) Inventor: George Luttig, Ontario (CA)

(73) Assignee: Don Emler, Los Angeles, CA (US)

( * ) Notice: Subject to any disclaimer, the term of this patent is extended or adjusted under 35 U.S.C. 154(b) by 0 days.

(21) Appl. No.: 11/763,637

(22) Filed: Jun. 15, 2007

(65) Prior Publication Data

US 2008/0308347 A1 Dec. 18, 2008

(51) Int. Cl.
*F01N 1/08* (2006.01)
*F01N 1/10* (2006.01)
*F01N 1/24* (2006.01)
*F01N 1/02* (2006.01)

(52) U.S. Cl. ..... 181/250; 181/252; 181/256; 181/267; 181/281

(58) Field of Classification Search ..... 181/251, 181/252, 256, 257, 258, 267, 269, 281
See application file for complete search history.

(56) References Cited

U.S. PATENT DOCUMENTS 1,087,468 A * 2/1914 Steinmetz ..... 181/269
1,820,972 A 9/1931 Haas
1,881,051 A 10/1932 Haas
1,900,027 A 3/1933 Radecky
1,927,213 A 9/1933 MacKenzie et al.
1,995,071 A 3/1935 MacKenzie et al.
2,122,086 A * 6/1938 Adelbert ..... 181/269
2,392,559 A * 1/1946 Chand ..... 181/258
2,523,260 A 9/1950 Campbell
2,570,728 A * 10/1951 Storey ..... 181/243
2,583,366 A * 1/1952 Engels ..... 181/252
3,415,336 A * 12/1968 Arthur et al. ..... 181/252
3,545,565 A 12/1970 McCaffrey, Jr.
3,710,891 A 1/1973 Flugger
3,765,506 A 10/1973 Strunk
3,858,678 A 1/1975 Harren
3,901,350 A * 8/1975 Loffelhardt ..... 181/256
3,981,378 A * 9/1976 Potter ..... 181/230
4,109,753 A 8/1978 Lyman
4,325,459 A 4/1982 Martin
4,356,885 A 11/1982 Dello
4,367,808 A * 1/1983 Oberg ..... 181/272
4,487,289 A 12/1984 Kicinski et al.
4,550,799 A 11/1985 Flugger
4,595,073 A * 6/1986 Thawani ..... 181/265
5,101,930 A * 4/1992 Fargo et al. ..... 181/233
5,371,331 A 12/1994 Wall
5,892,186 A * 4/1999 Flugger ..... 181/252
5,992,560 A * 11/1999 Matsuoka et al. ..... 181/252
6,241,044 B1 * 6/2001 Nishiyama et al. ..... 181/272
6,510,921 B2 * 1/2003 Price ..... 181/264
6,550,572 B2 * 4/2003 Lin ..... 181/252
6,640,927 B1 11/2003 Turner
6,715,583 B2 4/2004 Santos (Continued)

*Primary Examiner*—Edgargo San Martin
(74) *Attorney, Agent, or Firm*—Shook, Hardy & Bacon LLP

(57) ABSTRACT

A system and method for dissipating at least one pressure wave in an exhaust gas flow is disclosed. A vehicular exhaust system directs the exhaust gas flow through a plurality of coaxial and perforated generally cylindrical tubes contained within an insulated canister towards a perforated partition plate. Through a series of apertures in the tubes and plate, the at least one pressure wave is dissipated such that sound attenuation is achieved without output loss from the engine.

19 Claims, 5 Drawing Sheets

U.S. PATENT DOCUMENTS 6,857,502 B2 * 2/2005 Naito ..... 181/252
6,880,670 B2 4/2005 Dondi
6,968,922 B2 11/2005 Kawamata et al.
7,063,134 B2 6/2006 Poole et al.
7,380,397 B2 * 6/2008 Chang ..... 60/324
2005/0051382 A1 3/2005 Borgmeier
2005/0161283 A1 7/2005 Emler
2006/0243521 A1 11/2006 Price
2007/0158135 A1 * 7/2007 Shimomura ..... 181/251

* cited by examiner

VEHICULAR EXHAUST SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This invention relates to providing a system for improved exhaust evacuation from an internal combustion engine.

Internal combustion engines serve to power a majority of the powered vehicles worldwide. Typically, internal-combustion-driven vehicles comprise at least one system for transporting the exhaust gases from the combustion cylinder to at least one remote discharge point adjacent the vehicle. Commonly, the exhaust system will comprise a length of metallic pipe or similar fluid-transporting conduit. In most vehicles, the exhaust system will further include at least one sound-modifying device such as a muffler or silencer.

Typical "performance" mufflers, such as those found on an off-road or road-going motorcycle, are mounted high and rearward on the vehicle. Preferably, a muffler should be located as close as possible to the center of vehicle mass so as to improve vehicle handling by lessening the dynamic loads imposed on suspension systems by reducing the outer rotating mass of the vehicle.

Internal combustion engines operate by drawing power from a controlled explosion within a combustion cylinder. In a typical four-stroke combustion cycle, an intake mixture of air and fuel is drawn into the combustion cylinder, compressed, ignited to produce power, and finally discharged from the engine to the exhaust system. Generally, the engine performance is directly related to the volume of air/fuel mixture that can be introduced into the combustion cylinder during each cycle. Restrictions in the exhaust system can prevent full evacuation of the combustion gases from the cylinder, resulting in an inability of the engine to fully recharge the cylinder with a subsequent volume of fuel/air mixture. Therefore, deriving maximum power from any engine requires an exhaust system designed with the free-flow of exhaust gases as a primary objective. Unfortunately, exhaust systems often sacrifice flow in favor of other factors, for example, the reduction of sound emissions during operation.

A need exists for an improved muffler design that both reduces sound output while minimizing horsepower loss. This exhaust system must also meet the sound output requirements of sanctioned racing organizations as well as state and local regulations. Furthermore, due to increasing pressure from controlling bodies to set decibel (db) sound limits for motorized vehicles operating within public lands, a need exists for a high-performance exhaust system that provides necessary reductions in sound emissions, while maintaining a high degree of performance.

SUMMARY

The present invention is defined by the claims below. Embodiments of the present invention solve at least the above problems by providing a system and method for, among other things, dissipating at least one pressure wave in a vehicular exhaust system. The present invention has several practical applications in the technical arts including as a muffling component for a high-performance vehicle, such as a motorcycle.

In a first aspect, a vehicular exhaust system for effectively dissipating at least one pressure wave is disclosed. The exhaust system comprises first and second coaxial and generally cylindrical tubes with the second tube surrounding the first tube so as to form a first generally annular passageway therebetween. Each of the tubes have a plurality of apertures located about their surface. A partition plate, having a third plurality of apertures, is located within the first generally cylindrical tube. The first generally annular passageway increases in volume around the axial location of the partition plate. Surrounding the first and second generally cylindrical tubes is a canister that has a generally cylindrical wall, an inlet opening, and an outlet opening. The canister also contains an insulating material located between the cylindrical wall and the second generally cylindrical tube for the purposes of absorbing heat and sound from the first and second generally cylindrical tubes. The partition plate permits a portion of the at least one pressure wave to pass through the plate while directing the remaining portion into the first generally annular passageway and around the partition plate.

In a second aspect, a vehicular exhaust system is disclosed. The exhaust system comprises an inner core assembly and a canister that encompasses the inner core assembly. The inner core assembly comprises a first generally cylindrical tube having a first diameter that tapers to a smaller second diameter and a second generally cylindrical tube having a constant diameter. Each of the first and second generally cylindrical tubes are perforated with a plurality of apertures. Coupled to the first generally cylindrical tube is an outlet tube for directing the exhaust gas to the atmosphere. Located within the first generally cylindrical tube is a partition plate having a plurality of apertures so as to permit a portion of the pressure wave to pass through the plate while directing the remaining portion into the first generally annular passageway and around the partition plate. The canister contains an insulating material between the generally cylindrical wall of the canister and the inner core assembly.

In a third aspect, a method of dissipating at least one pressure wave in a vehicular exhaust system is disclosed. The method comprises utilizing a vehicular exhaust system comprising first and second generally cylindrical tubes, each having a plurality of apertures, with a passageway formed between the tubes and the first generally cylindrical tube containing a partition plate having a third plurality of apertures. A fluid flow is directed is directed through an inlet opening in the canister and into the first tube where a first portion of the fluid passes through the apertures in the first tube and into the passageway. Furthermore, some of this first portion passes through the apertures in the second tube and into the canister. A second portion of the fluid passes through the third plurality of apertures in the partition plate while the remaining fluid is directed through the first plurality of apertures and into the passageway proximate the partition plate, so as to pass around the partition plate. The fluid that passes through the passageway is directed either through the second plurality of apertures and into the canister or back into the first tube, downstream of the partition plate, and towards an outlet opening in the canister.

Through the structure and method disclosed herein the at least one pressure wave that passes through the exhaust system is significantly dissipated by the plurality of apertures located in the coaxial tubes, the partition plate, as well as in the insulation material in the canister.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
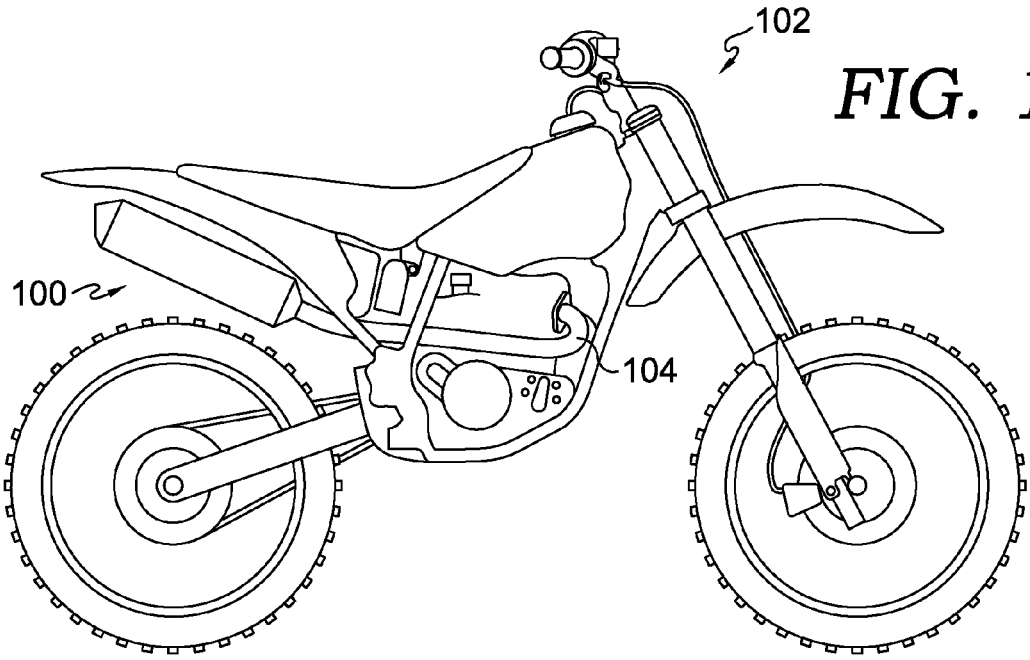
FIG. 1 is an elevation view of a vehicle utilizing an exhaust system in accordance with an embodiment of the present invention.

The present invention will now be described in greater detail with reference to the accompanying FIGS. 1-9. Referring initially to FIG. 1, an elevation view of a vehicular application of the present invention is shown. FIG. 1 depicts an exhaust system 100 for use on a vehicle 102, which in this case is an off-road motorcycle that typically utilizes a four-stroke internal combustion engine. An example of the vehicle 102 is a model CRF 450 manufactured by Honda Motor Co., Inc. Those skilled in the art will appreciate that the vehicle shown in FIG. 1 is a single example and the present invention is not limited to application to any one particular bike size, type, or manufacturer. It can also be appreciated that although the exhaust system presented herein is preferred for smaller displacement engines, such as those powering motorcycles, all-terrain vehicles, snowmobiles, and personal watercraft, the system is adaptable to vehicles comprising larger displacement engines such as automobiles, trucks, and aircraft.

The vehicular exhaust system 100 of the present invention dissipates at least one pressure wave that passes thought the exhaust system. Pressure waves are inherently present in the flow of gases from the internal combustion engine powering the vehicle 102. The gases, and pressure waves, travel from the engine through a series of conduits 104 to the exhaust system 100. The exact orientation and arrangement of the conduits will vary depending on the engine size, location, and other specifics of the vehicle 102.

Figure 2:
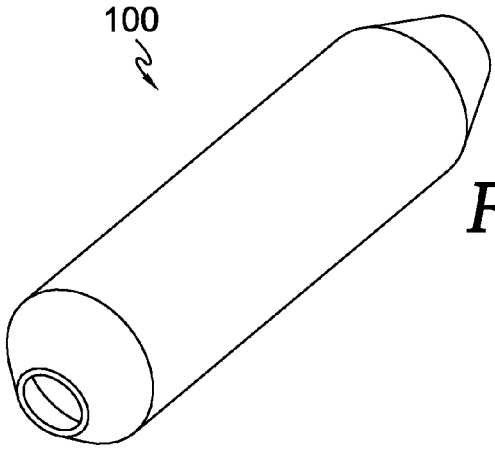
FIG. 2 is a perspective view of a vehicular exhaust system in accordance with an embodiment of the present invention.
Figure 3:
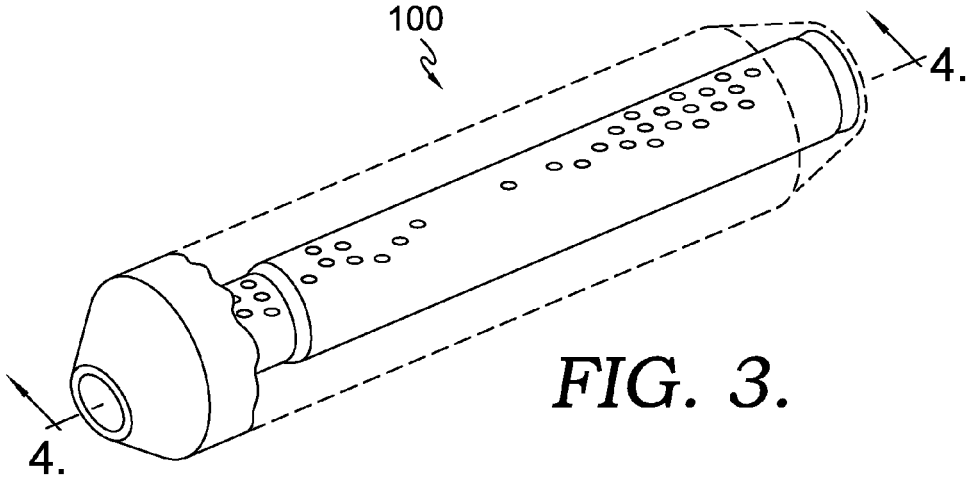
FIG. 3 is a partial cut-away perspective view of a vehicular exhaust system in accordance with an embodiment of the present invention.

The exhaust system 100 is shown in perspective view in FIGS. 2 and 3, in which FIG. 3 depicts the exhaust system 100 in a partial cut-away view. Referring now FIG. 4, the exhaust system 100 comprises a first generally cylindrical tube 104 having a first end 106 and a second end 108 located a distance from the first end 106 such that the first generally cylindrical tube 104 has a first length L1. The first generally cylindrical tube 104, which is preferably fabricated from a stainless steel having an outside diameter preferably ranging between approximately 1.75 inches and 1.875 inches, also has a first plurality of apertures 110. These apertures are generally round in shape and can vary in diameter, however, the exact shape could vary as well depending on the operating requirements of the exhaust system.

Positioned radially outward of the first generally cylindrical tube 104 and coaxial therewith is a second generally cylindrical tube 112 that extends a second length L2 from the first end 106 and is also preferably fabricated from a stainless steel having an outside diameter preferably ranging from approximately 2.00 inches to 2.125 inches. The radial position of the second generally cylindrical tube 112 thereby creates a first generally annular passageway 114 between the first and second generally cylindrical tubes 104 and 112, respectively. The second generally cylindrical tube 112 has a second plurality of apertures 116. In the embodiment shown in FIG. 4, the first plurality of apertures 110 and second plurality of apertures 116 are the same size. However, one skilled in the art will understand that these aperture diameters could vary and may or may not be the same size. It should be noted that although for the embodiment discussed above, the cylindrical tubes are preferably fabricated from stainless steel, they can also be fabricated from other materials such as, but not limited to, mild steel, Titanium, and Inconnel.

Coupled to the second end 108 of the first generally cylindrical tube 104 is a generally cylindrical outlet tube 118. Exhaust gases exit from the first generally cylindrical tube 104 through the outlet tube 118. The flow of exhaust gases are depicted by arrows in FIG. 5, but will be discussed in more detail below.

A partition plate 120 is positioned within the first generally cylindrical tube 104 at an axial distance X along the first length L1. The plate 120 has a third plurality of apertures 122. The partition plate 120, which is preferably fabricated from a stainless steel, also has a surface area with a rounded edge 124, which extends in an axial direction towards the first end 106 of the first generally cylindrical tube. It is the axial extension of the rounded edge 124 that properly orients the partition plate 120 generally perpendicular to the first generally cylindrical tube 104.

Figure 5:
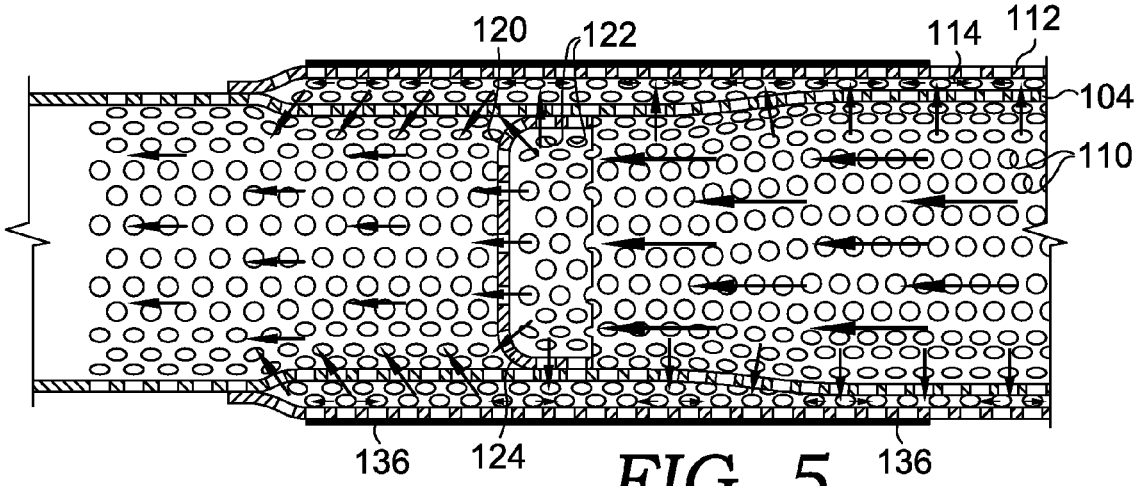
FIG. 5 is a detailed cross section view of a portion of the vehicular exhaust system shown in FIG. 4 depicting the exhaust gas flowpath in accordance with an embodiment of the present invention.
Figure 6:
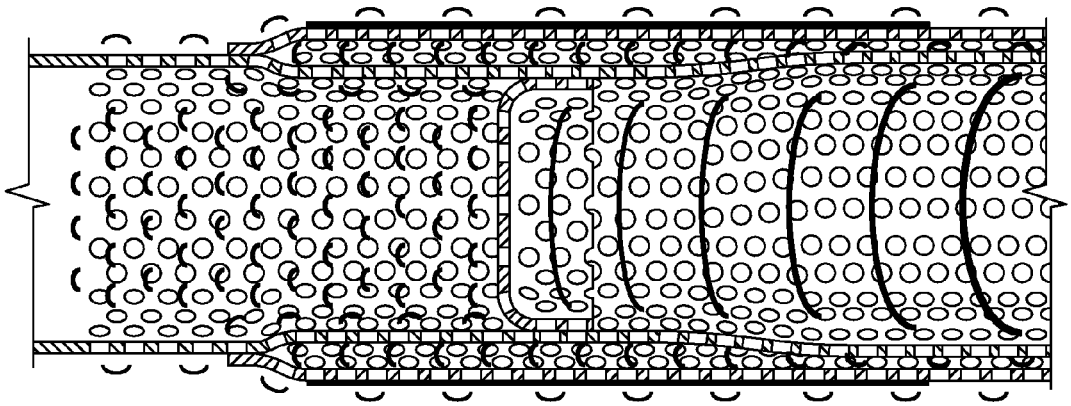
FIG. 6 is a detailed cross section view of a portion of the vehicular exhaust system shown in FIG. 4 depicting the exhaust sound pulses in accordance with an embodiment of the present invention.
Figure 7:
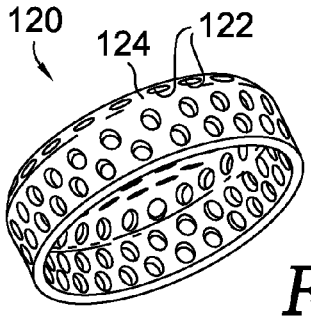
FIG. 7 is a perspective view of a partition plate of the vehicular exhaust system in accordance with an embodiment of the present invention.

The partition plate 120 is shown in greater detail in FIGS. 5-7. It is critical that the partition plate is oriented perpendicular to the exhaust gas flow. Otherwise, the high temperature exhaust gas flow would be directed preferentially towards one side of the first generally cylindrical tube 104 exposing that side to higher operating temperatures and shortening the life of the exhaust system. The partition plate 120 is perforated with the third plurality of apertures 122 in order to dissipate the pressure wave(s) so as to permit some of the hot exhaust gas to pass directly through the plate 120 and not direct all of the hot exhaust gases to impact the first generally cylindrical tube 104. During development testing, a solid plate configuration showed decreased performance and caused too much heat to build-up in the canister surrounding the tubes. The size and quantity of the apertures in the partition plate 120 cover approximately 45% of the plate surface area. This range provides an acceptable compromise between engine performance and sound attenuation. As one skilled in the art will understand, more holes in the partition plate results in better performance of the engine (i.e. more horsepower), but fewer holes offers better sound attenuation by providing more blockage, and thereby dissipation, of the sound waves.

Figure 4:
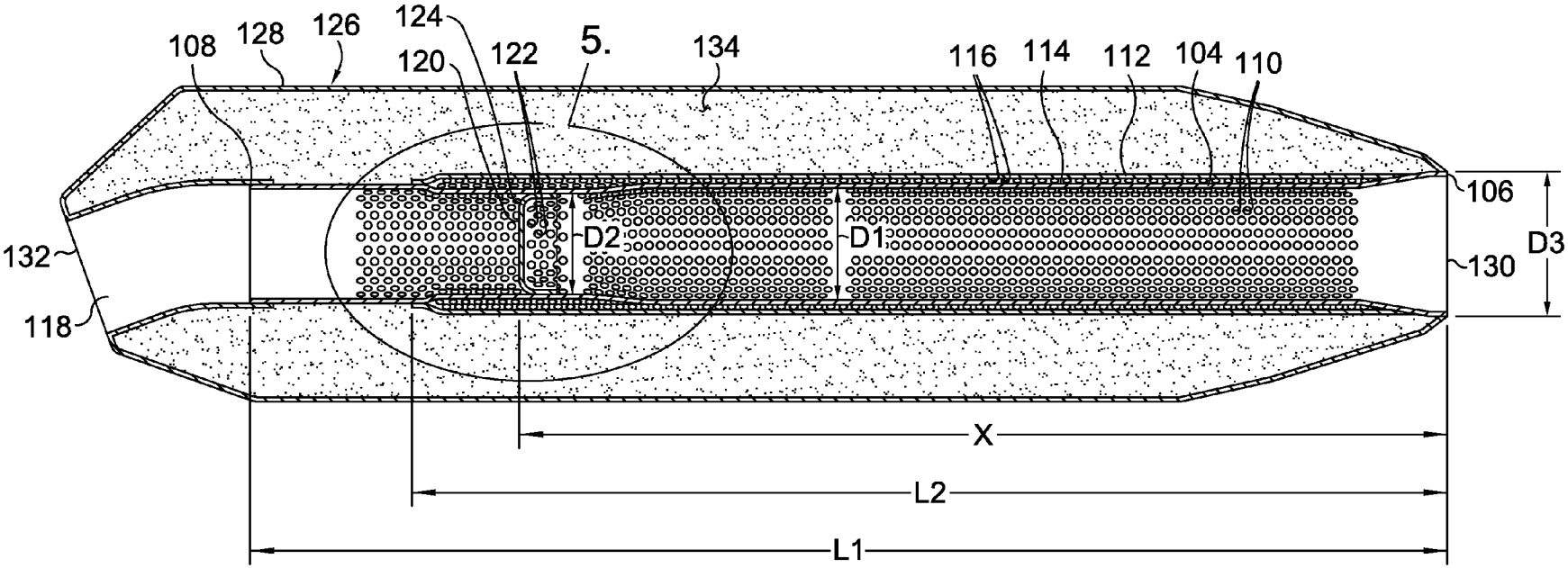
FIG. 4 is a cross section of the vehicular exhaust system shown in FIG. 2 in accordance with an embodiment of the present invention.

For the embodiment shown in FIG. 4, the vehicular exhaust system 100 also comprises a canister 126 having a generally cylindrical wall 128 that tapers towards an inlet opening 130 and an outlet opening 132. The first end 106 of the first generally cylindrical tube 104 is fixed to the inlet opening 130 of the canister 126 while the outlet tube 118 is fixed to the outlet opening 132 of the canister 126. The canister 126 also contains an insulating material 134 between the generally cylindrical wall 128 and the second generally cylindrical tube 112. The insulation material 134 is preferably an E-type fiberglass while the canister 126 is preferably either aluminum, titanium, stainless steel, or carbon fiber. It was determined that increasing the canister volume from 126.5 cubic inches to 149 cubic inches, in combination with the coaxial perforated tubes and partition plate disclosed herein, reduced the sound level by 1 db. Increasing the canister volume from 149 cubic inches to 182 cubic inches resulted in an additional 2 db noise reduction. For such a canister volume, in conjunction with the other components of the vehicular exhaust system, a slight increase of 0.2 horsepower was realized below 5000 RPM. No power increase was obtained above 5000 RPM.

As previously discussed, the first generally cylindrical tube 104 is positioned within the second generally cylindrical tube 112, thereby forming a generally annular passageway 114 therebetween. The first generally cylindrical tube 104 further comprises a first diameter D1 that tapers to a second diameter D2 that is smaller than the first diameter D1. The axial location of this taper is slightly upstream of the partition plate 120. In this embodiment, the second generally cylindrical tube 112 further comprises a constant diameter D3. As such, the volume of the first generally annular passageway 114 formed between the first generally cylindrical tube 104 and the second generally cylindrical tube 112 increases for the axial region adjacent the partition plate 120. Such an increase in volume is beneficial so as to allow for passage of the additional flow not passing through the partition plate 120, but instead around the plate 120.

Figure 8:
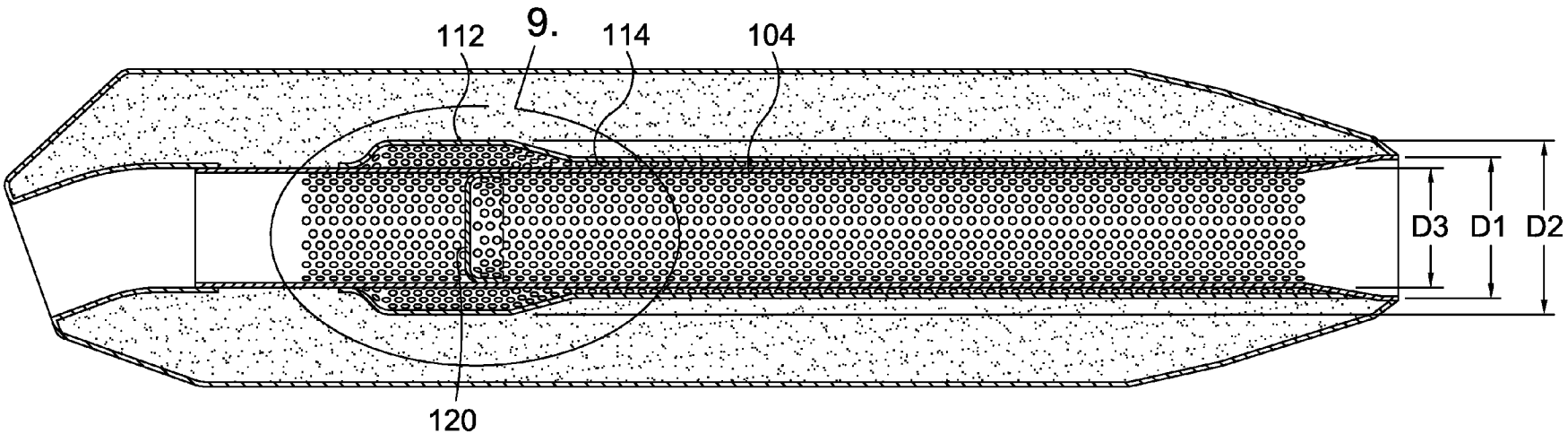
FIG. 8 is a cross section view the vehicular exhaust system in accordance with an alternate embodiment of the present invention.
Figure 9:
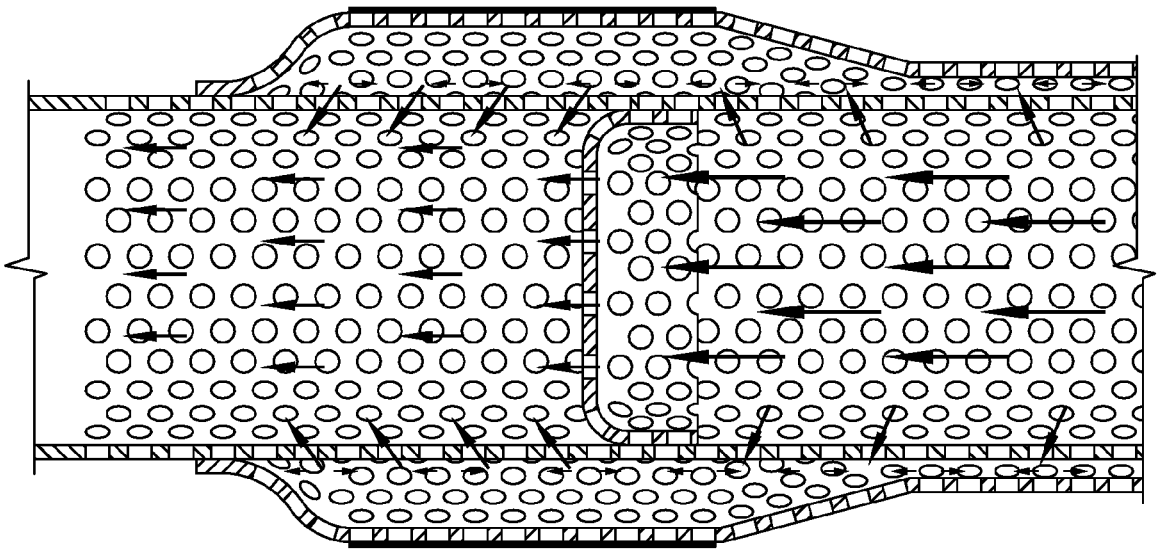
FIG. 9 is a detailed cross section view of a portion of the vehicular exhaust system shown in FIG. 8 depicting the exhaust gas flowpath in accordance with an alternate embodiment of the present invention.

In an alternate embodiment of the present invention, the first generally cylindrical tube 104 further comprises a constant diameter D3 and the second generally cylindrical tube 112 further comprises a first diameter D1 that tapers to a larger second diameter D2. This embodiment is shown in FIGS. 8 and 9. In this embodiment, the first generally annular passageway 114 also increases in volume proximate the second diameter D2 of the second generally cylindrical tube 112. In this embodiment, the partition plate 120 is located axially within the first generally cylindrical tube 104 proximate the second diameter D2. Positioning the partition plate 120 at this location relative to the larger diameter D2 and larger passageway volume ensures that the gas flow directed into the passageway 114 by the partition plate 120 can pass through the passageway 114. Whether the first generally cylindrical tube 104 or the second generally cylindrical tube 112 has the constant diameter is a matter of choice, as the effective volume increase in the passageway 114 is essentially the same for both designs.

An additional feature of the present invention is a wire screen 136 that is attached to the outer surface of the second generally cylindrical tube 112 at an axial location proximate the partition plate 120 (see FIG. 5). The wire screen has a very fine mesh and is needed to help diffuse the energy associated with rather strong waves, or pulses, of hot gases that develop around the partition plate 120.

The partition plate 120 permits a portion of the at least one pressure wave passing through the exhaust system to pass through the third plurality of apertures 122 while directing the remaining portion to pass through the first plurality of apertures 110 and into the first generally annular passageway 114. This function will be better understood in view of the following method of operation.

A method of dissipating at least one pressure in a fluid passing through a vehicular exhaust system comprises providing a vehicular exhaust system 100 as previously discussed in which a first generally cylindrical tube 104 has a first plurality of apertures 110, a second generally cylindrical tube 112 is coaxial to the first tube 104 and has a second plurality of apertures 116, where a passageway 114 is formed between the tubes, and a partition plate 120 having a third plurality of apertures 122 is located in the first tube 104. These tubes are located within a canister 126. A fluid is directed through the inlet opening 130 in the canister 126 and into the first generally cylindrical tube 104. As it can be seen from FIGS. 4-6, a first portion of the fluid is permitted to pass through the first plurality of apertures 110 and into the first passageway 114 where some of the first portion can pass through the second plurality of apertures 116 and into the canister 126. The sound waves present in the fluid in the first tube 104 are partially dissipated as the fluid passes through the first plurality of apertures 110 and are further dissipated by passing through the second plurality of apertures 116 and into the canister 126, which contains an insulation material 134. Fluid that does not pass through the first plurality apertures 110 travels downstream towards the outlet opening 132. Upon contact with the partition plate 120, a second portion of the fluid is permitted to pass through the third plurality of apertures 122 in the partition plate 120 while the remaining fluid is directed through the first plurality of apertures 110 adjacent to the partition plate 120 and into the first passageway 114. The fluid that is present in the first passageway is directed either through the second plurality of apertures 116 into the insulation 134 or back into the first tube 104, downstream of the partition plate 120, and towards an outlet opening 132 in the canister 126.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A vehicular exhaust system for dissipating at least one pressure wave, the system comprising:

a first generally cylindrical tube having a first end that receives the at least one pressure wave, a second end that directs the at least one pressure wave to an outlet tube, a first length extending therebetween, and a first plurality of apertures contained therein;

a second generally cylindrical tube extending a second length from a proximal end proximate to the first end to a distal end, the second generally cylindrical tube located radially outward of the first generally cylindrical tube and coaxial therewith, thereby forming a first generally annular passageway between the first generally cylindrical tube and the second generally cylindrical tube, the second generally cylindrical tube having a second plurality of apertures that are substantially the same size as the first plurality of apertures;

the outlet tube coupled to the first generally cylindrical tube;

a partition plate positioned within the first generally cylindrical tube at an axial distance along the first length, wherein the axial distance is slightly shorter than the second length and the partition plate is positioned proximate to the distal end of the second generally cylindrical tube, the partition plate having a third plurality of apertures, and the partition plate being located adjacent to a taper of a diameter of the first or the second generally cylindrical tube; and a canister having a generally cylindrical wall, an inlet opening, and an outlet opening, wherein the first end of the first generally cylindrical tube is fixed to the inlet opening and the outlet tube is fixed to the outlet opening of the canister, the canister containing an insulating material between the cylindrical wall and the second generally cylindrical tube;

wherein the partition plate permits a portion of the at least one pressure wave to pass through the third plurality of apertures in the partition plate and directs the remaining portion of the at least one pressure wave to pass through the first plurality of apertures and into the first generally annular passageway.

2. The system of claim 1 wherein the first generally cylindrical tube further comprises a first diameter extending a first portion of the first length that tapers to a smaller second diameter extending a second portion of the first length and the second generally cylindrical tube further comprises a constant diameter, wherein an axial location of the taper from the first diameter to the smaller second diameter is located slightly upstream of the partition plate, the taper extending a third portion of the first length, the third portion located in a region proximate to the partition plate.

3. The system of claim 2 wherein the first generally annular passageway increases in volume proximate the second diameter of the first generally cylindrical tube, wherein the third portion of the first length that includes the taper to the second diameter is positioned proximate to the distal end of the second generally cylindrical tube.

4. The system of claim 2 wherein the partition plate is located axially within the first generally cylindrical tube proximate the second diameter.

5. The system of claim 1 wherein the first generally cylindrical tube further comprises a constant diameter and the second generally cylindrical tube further comprises a first diameter extending a first portion of the first length that tapers to a larger second diameter extending a second portion of the first length, wherein an axial location of the taper from the first diameter to the larger second diameter is located slightly upstream of the partition plate, the taper extending a third portion of the first length, the third portion located in a region proximate to the partition plate.

6. The system of claim 5 wherein the first generally annular passageway increases in volume proximate the second diameter of the second generally cylindrical tube.

7. The system of claim 5 wherein the partition plate is located axially within the first generally cylindrical tube proximate the second diameter.

8. The system of claim 1 wherein the second generally cylindrical tube further comprises a wire screen having a very fine mesh configured to diffuse energy associated with the at least one pressure wave located about an outer surface of the second generally cylindrical tube and axially proximate the partition plate.

9. The system of claim 1 wherein the partition plate has a surface area and a rounded edge, the plate oriented generally perpendicular to the first generally cylindrical tube such that the edge extends in an axial direction towards the first end of the first generally cylindrical tube.

10. The system of claim 1 wherein the third plurality of apertures in the partition plate cover approximately 45%-60% of the surface area.

11. A vehicular exhaust system comprising:

an inner core assembly comprising:

a first generally cylindrical tube having a first end, a second end, a first length extending therebetween, and a first plurality of apertures contained therein, the first generally cylindrical tube having a first diameter that tapers to a smaller second diameter;

a second generally cylindrical tube located radially outward of the first generally cylindrical tube and coaxial therewith, thereby forming a first generally annular passageway between the first generally cylindrical tube and the second generally cylindrical tube, the second generally cylindrical tube having a second plurality of apertures and a constant diameter that extends a second length from proximate the first end;

an outlet tube coupled to the first generally cylindrical tube;

a partition plate positioned within the first generally cylindrical tube at an axial distance along the first length proximate the second diameter, the partition plate having a third plurality of apertures and a surface area, wherein the third plurality of apertures in the partition plate cover approximately 45%-60% of the surface area; and a canister having a generally cylindrical wall, an inlet opening, and an outlet opening, the canister encompassing the inner core assembly and containing an insulating material between the inner core assembly and the generally cylindrical wall;

wherein the partition plate permits a portion of the at least one pressure wave to pass through the third plurality of apertures in the partition plate and directs the remaining portion of the at least one pressure wave to pass through the first plurality of apertures and into the first generally annular passageway.

12. The system of claim 11 wherein the second generally cylindrical tube further comprises a wire screen located about the second generally cylindrical tube and axially proximate the partition plate.

13. The system of claim 11 wherein the partition plate is located along the first length at an axial distance that is significantly greater from the first end of the first generally cylindrical tube than from the second end of the first generally cylindrical tube.

14. The system of claim 13 wherein the partition plate has a rounded edge, the plate is oriented generally perpendicular to the first generally cylindrical tube such that the edge extends in an axial direction towards the first end of the first generally cylindrical tube.

15. The system of claim 11 wherein the insulating material located within the canister absorbs part of the portion of the at least one pressure wave that exits from the first generally annular passageway through the second plurality of apertures.

16. A method of dissipating at least one pressure wave in a fluid passing through a vehicular exhaust system, the method comprising:

providing a vehicular exhaust system comprising a generally cylindrical canister having coaxial first and second tubes located therein, wherein the first tube has a first plurality of apertures, the second tube has a second plurality of apertures, a passageway formed between the first and second passageway, and a partition plate having a third plurality of apertures is located in the first tube, wherein the first tube has a first end that receives the at least one pressure wave, a second end that directs the at least one pressure wave to an outlet tube, and a first length extending therebetween, and wherein the partition plate is located along the first length at an axial distance that is significantly greater from the first end of the first generally cylindrical tube than from the second end of the first generally cylindrical tube;

directing the fluid flow through an inlet opening in the canister and into the first tube via the first end;

permitting a first portion of the fluid to pass through the first plurality of apertures and into the first passageway whereupon some of the first portion passes through the second plurality of apertures and into the canister;

permitting a second portion of the fluid to pass through the third plurality of openings in the partition plate;

directing the remaining fluid through the first plurality of apertures and into the first passageway proximate the partition plate, wherein a volume of the first passageway is increased by a taper located slightly upstream of the partition plate, wherein the taper encompasses a portion of the first length that decreases a diameter of the first tube from a first diameter to a smaller second diameter, the portion of the first length located in a region proximate to the partition plate; and directing the fluid present in the first passageway either through the second plurality of apertures or back into the first tube and towards an outlet opening in the canister.

17. The method of claim 16 further comprising absorbing some of the pressure wave from the first portion that passes through the second plurality of apertures with the insulation.

18. The method of claim 16 wherein the fluid is exhaust gas from an internal combustion engine.

19. The method of claim 16 wherein the at least one wave contained in the fluid is dissipated into a plurality of smaller waves by at least the partition plate and the first, second, and third plurality of apertures.

* * * * *